US006210259B1

(12) United States Patent
Malkin et al.

(10) Patent No.: US 6,210,259 B1
(45) Date of Patent: Apr. 3, 2001

(54) METHOD AND APPARATUS FOR LAPPING OF WORKPIECES

(75) Inventors: Daniel Malkin; Lev Malkin, both of Toronto (CA)

(73) Assignee: Vibro Finish Tech Inc., Toronto (CA)

( * ) Notice: Subject to any disclaimer, the term of this patent is extended or adjusted under 35 U.S.C. 154(b) by 0 days.

(21) Appl. No.: 09/435,692

(22) Filed: Nov. 8, 1999

(51) Int. Cl.[7] ..... B24B 7/00

(52) U.S. Cl. ..... 451/166; 451/259; 451/262; 451/268; 451/269; 451/270; 451/271

(58) Field of Search ..... 451/259, 262, 451/268, 269, 270, 271

(56) References Cited

U.S. PATENT DOCUMENTS

| | | | | |
|---|---|---|---|---|
| 2,045,488 | | 6/1936 | Oubridge . | |
| 2,142,057 | | 12/1938 | Hulbert et al. . | |
| 2,262,725 | | 11/1941 | Indge . | |
| 2,419,033 | | 4/1947 | Primus . | |
| 2,709,321 | | 5/1955 | Indge . | |
| 2,709,876 | * | 6/1955 | Indge | 451/269 |
| 2,740,237 | | 4/1956 | Day et al. . | |
| 3,537,214 | | 11/1970 | Ford . | |
| 3,541,734 | | 11/1970 | Clar . | |
| 3,662,498 | * | 5/1972 | Caspers | 451/269 |
| 3,890,114 | | 6/1975 | Bovensiepen . | |
| 3,925,936 | | 12/1975 | Orlov et al. . | |
| 4,157,637 | * | 6/1979 | Orlov et al. | 451/291 |
| 4,205,489 | | 6/1980 | Orlov et al. . | |
| 4,418,501 | | 12/1983 | Desantis . | |
| 4,916,868 | * | 4/1990 | Wittstock | 451/28 |
| 5,016,399 | | 5/1991 | Vinson . | |

FOREIGN PATENT DOCUMENTS

| | | |
|---|---|---|
| 18151 | 9/1966 | (SU) . |
| 227127 | 7/1968 | (SU) . |

* cited by examiner

*Primary Examiner*—David A. Scherbel
*Assistant Examiner*—Shantese McDonald
(74) *Attorney, Agent, or Firm*—Bereskin & Parr

(57) ABSTRACT

A lapping assembly for lapping a group of workpieces including a pair of lapping discs and a cassette for positioning the workpieces between the lapping discs. The lapping discs are provided with two-component translational oscillations at the appropriate cutting speed, parallel to their working planes. This motion is effected using crank pins rotating about a coaxially positioned axis and elastic members (or swivel-supporting) members coupled to the body of the lapping machine to prevent the lapping discs from rotating. The cassette has an opening having a curvilinear shape for holding the workpieces, and protrusions which extend into the opening. The cassette is mounted on a support element and equipped with a drive to rotate it about a stationary axis. Alternatively, the cassette can be fixed during treatment and the lapping discs can be rotated at a speed less than the cutting speed. The combination of the curvilinear shape of the opening, the oscillations provided to the cassette and the relative rotation of the cassette in relation to the lapping discs cause workpieces to circulate within opening in a pseudo-random manner. The apparatus may also be adapted to finish workpieces to differing heights through the use of a sensor coupled to one lapping disc to detect the pre-set proximity of the other lapping disc.

19 Claims, 10 Drawing Sheets

METHOD AND APPARATUS FOR LAPPING OF WORKPIECES

FIELD OF THE INVENTION

The present invention relates generally to lapping apparatus, and more particularly to an improved method and apparatus for lapping a group of flat-parallel or cylindrical workpieces.

BACKGROUND OF THE INVENTION

Lapping machines are used to treat the surfaces of workpieces using an abrasive assembly. Typically, lapping machines include upper and lower lapping discs which are made of a strong material and have precisely flat working surfaces which are loaded with an abrasive compound. Workpieces are carried within a cassette that is positioned between the upper and lower lapping discs and which effect treatment of the workpieces. Typically, the axes of the lapping discs are vertical and coaxial and treatment is accomplished by rotating one or both discs relative to the cassette such that the appropriate surfaces of the individual workpieces are abrased by the working surfaces of the lapping discs.

During the treatment of workpieces, it is desirable to ensure minimal differences in thickness (or diameter if the workpieces are cylindrical) between individual workpieces and that the top and bottom sides of each workpiece are essentially parallel to eachother and flat. Care must be taken to avoid lapping constantly over the same areas of the lapping disc so that the surface of lapping disc is evenly utilized. If the working surfaces of the lapping discs are unevenly worn, the surfaces of the workpieces cannot be lapped to a high finish and to an accurate flatness. Since the speed of each particle on the abrasive surface of the lapping discs is proportional to the distance between the centre of rotation and the particle, it is necessary to provide workpieces with an appropriate trajectory of movement between the lapping discs in order to minimize radial deformation of the working surfaces of the lapping discs and to optimize the accuracy of finishing of the workpieces.

In order to ensure even wear of the working surfaces of lapping discs, prior art lapping machines utilize cassettes that have sockets formed within for holding individual workpieces and which allow the cassette to be rotated independently from the lapping discs. Accordingly, the workpieces are provided with radial movement having a changing vector of velocity relative to the vertical axis of the lapping discs and move along a spiral trajectory relatively to the lapping disks.

One type of assembly which effects such movement of workpieces is a planetary lapping machine as in U.S. Pat. No. 3,662,498 to Caspers and U.S. Pat. No. 4,157,637 to Orlov et al. A planetary lapping machine utilizes a number of circular cages, each cage having individual workpiece sockets. Each cage is driven by a sun gear and a ring gear of a sun-and-planet gear which are rotated on vertical shafts coaxial with annular upper and lower lapping discs. This construction ensures that the center of workpieces being machined are moved along spiral trajectories over the working surface of the lower and upper lapping discs. Planetary movement is composed of the joint motion of the circular motion of each individual workpiece socket rotating within a circular cage around the individual cage axis and the larger circular orbiting movement of each socket around the axis of the lapping discs.

Another type of lapping assembly is disclosed in U.S. Pat. No. 3,541,734 to Clar, which describes a dual-disc lapping machine. A dual-disc machine is generally used for lapping cylinders and includes a cassette which is driven by an eccentric crank pin so that the cassette rotates in an eccentric manner and at a different speed than the upper and lower discs.

Both types of lapping assembly suffer from substantial and well known disadvantages. Lapping discs are unevenly worn during the course of treatment of workpieces. Also, the required spacing of individual workpieces inside the cassettes results in a relatively low yield of treated workpieces from the lapping machines. Finally, since each workpiece must be individually housed within cassette sockets, labour intensive loading and unloading of workpieces from the cassette is required.

These disadvantages can be overcome as described in USSR Patent No. 181,516-66 to Malkin, by vibrating one or both of the lapping discs using a vibration generator to provide translational circular motion therein. Further, the lapping discs can be provided with additional motion so that the axis of the lapping discs circumscribe a cone. This techniques improves the precision and productivity of the workpiece finishing process by allowing loosely packed workpieces to move between the upper and lower lapping discs in an orderly manner.

Further, as described in USSR Patent No. 227,127-67 to Malkin, one of the lapping discs can be suspended on a shock-absorber and fixedly secured to an unbalanced-mass vibration generator. The lapping discs are connected to each other by elastic elements such as, for example, radial helical coil springs, whose total rigidity exceeds the total rigidity of the shock-absorber. This apparatus provides simultaneous finishing of both surfaces of the workpieces and allows the user to adjust the amount of material to be removed from the workpieces.

One disadvantage of these approaches is that particles on the surface of the lapping disks move in a vertical direction at a linear acceleration that is proportional to the radial distance of the particle from the center of the lapping discs. This causes the surfaces of the lapping discs to be worn into a conjugate spherical shape. This defect is especially apparent when large workpieces are treated and accordingly, such an approach is most appropriate for small workpieces. Also, prior art machines do not effectively move individual workpieces in relation to particles on the surface of the lapping discs, especially when the pressure applied to the surfaces of the workpieces is substantial. Finally, it is difficult to apply the same level of treatment to both sides of a workpiece, since the intensity of oscillations applied to one lapping disk connected to vibrator is higher than that of the other disk (especially when the working pressure is high) and since oscillations are imperfectly transferred through elastic couplings. This results in workpieces being treated primarily on one side.

Accordingly, there is a need for an improved lapping assembly which provides even treatment to both surfaces of a group of workpieces, which effects even wear to the surfaces of lapping discs, which is easy to load and unload, which allows for treatment of a large number of workpieces, which comprises relatively few parts, and which is durable and relatively inexpensive to manufacture.

BRIEF SUMMARY OF THE INVENTION

It is therefore an object of the present invention to provide a lapping assembly for lapping a group of workpieces at a predetermined cutting speed, said lapping assembly comprising:

(a) first and second lapping discs, said lapping discs arranged next to one another, each said lapping disc having a working surface with abrasive particles for lapping the surfaces of the workpieces;

(b) a cassette positioned between said lapping discs for holding the group of workpieces, said cassette having a curvilinear opening formed within and dimensioned to receive the group of workpieces, said opening being defined by an inner wall;

(c) an oscillating assembly coupled to said lapping discs for providing two-component translational oscillations to said lapping discs in directions which are parallel to said working surfaces of said lapping discs, said translational oscillations being provided at the cutting speed of the group of workpieces; and (d) a rotational assembly coupled to at least one of said cassette and said lapping discs, such that a point on the periphery of said cassette rotates in relation to an adjacent point on at least one of said lapping disks at a linear speed which is less than said cutting speed, such that the workpieces are caused to circulate within said opening of said cassette.

In another aspect the invention provides a lapping assembly for lapping a group of workpieces at a predetermined cutting speed, said lapping assembly comprising:

(a) first and second lapping discs, said lapping discs arranged next to one another, each said lapping disc having a working surface with abrasive particles for lapping the surfaces of the workpieces;

(b) a cassette positioned between said lapping discs for holding the group of workpieces, said cassette having an opening formed within and dimensioned to receive the group of workpieces, said opening being defined by an inner wall;

(c) an oscillating assembly comprising a first motor and first and second eccentric crank pins, said first eccentric crank pin being coupled to said first lapping disc and said second eccentric crank pin being coupled to said second lapping disc, said oscillating assembly providing two-component translational oscillations to said lapping discs in directions which are parallel to said working surfaces of said lapping discs, said translational oscillations being provided at the cutting speed of the group of workpieces.

In another aspect the invention provides a method of lapping a group of workpieces at a predetermined cutting speed, the workpieces being housed within a cassette having a curvilinear opening formed therein, said cassette being positioned between first and second lapping discs, said first and second discs each having a working surface having abrasive particles for lapping a surface of the workpieces, said method comprising the steps of:

(a) allowing said workpieces to move freely inside the opening of the cassette, said curvilinear shape serving to maintain the surfaces of the workpieces in contact with the working surfaces of the lapping discs;

(b) providing translational oscillations to the lapping discs in a plane parallel to the working surfaces of the lapping discs at the cutting speed; and (c) rotating said cassette in relation to at least one of the lapping discs, such that a point on the periphery of said cassette rotates in relation to an adjacent point on at least one of said lapping disks at a linear speed which is less than said cutting speed.

Further objects and advantages of the invention will appear from the following description, taken together with the accompanying drawings.

DETAILED DESCRIPTION OF PREFERRED EMBODIMENTS

Figure 1:
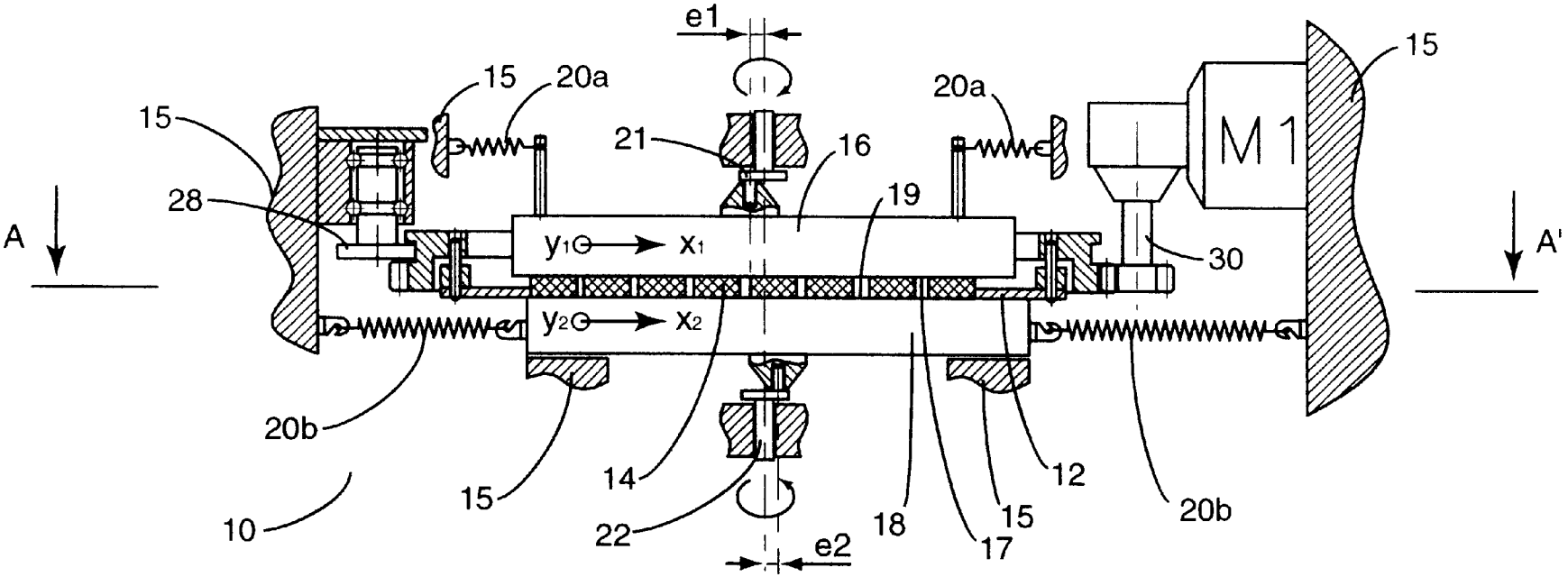
FIG. 1 is a side cross-sectional view of the lapping assembly according to a preferred embodiment of the present invention.
Figure 2:
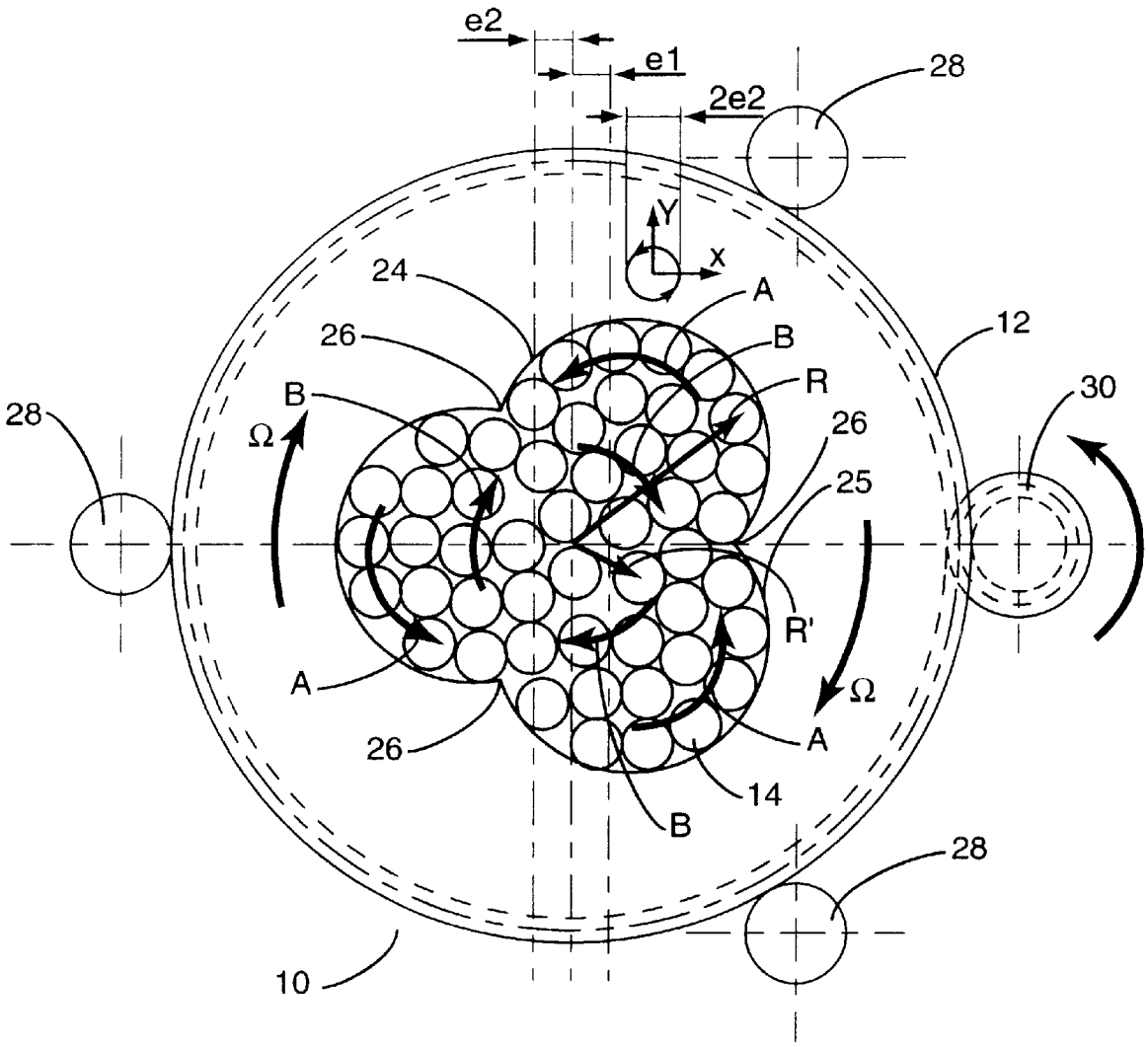
FIG. 2 is a sectional view of the lapping assembly taken along the line A—A' of FIG. 1.

Reference is first made to FIGS. 1 and 2, which show a lapping assembly 10 made in accordance with a preferred embodiment of the invention. Lapping assembly 10 includes a cassette 12 for holding a group of workpieces 14, first and second lapping discs 16, 18 for lapping a group of workpieces 14, elastic members 20*a* and 20*b* for preventing rotational movement of first and second lapping discs 16, 18, and crank pins 21 and 22 for effecting oscillation of first and second lapping discs 16, 18.

Cassette 12 is a generally round disc with an opening 24 (FIG. 2) dimensioned such that a substantial number of workpieces 14 may be located within opening 24 while still being able to freely circulate within opening 24. Cassette 12 is typically made out of a hard metal (e.g. steel alloy). It is contemplated that cassette 12 is preferably formed with a diameter in the range of between 150 and 2000 millimeters.

In a preferred embodiment, opening 24 is defined by wall 25 having a scalloped curvilinear shape (e.g. the three intersecting circular shapes as shown). Accordingly, a number of protrusions 26 are present along wall 25 of opening 24 which assist with the circulation of workpieces 14 within opening 24 when lapping assembly 10 is in operation, as will be described. It has been determined that the required angle of the sides of the protrusion 26 can be reduced as the flatness of first and second lapping discs 16, 18 is increased. Cassette 12 is mounted on several rollers 28 rotatably coupled to the body 15 of a lapping machine so that cassette 12 may rotate around a stationary axis. Rotation of cassette 12 may be effected through conventional means such as a gear rim 30 coupled to a cassette-drive motor M1. It should be understood that cassette 12 could be caused to rotate using alternate types of conventionally known mechanisms.

First and second lapping discs 16 and 18 are well known abrasive lapping discs, made of a strong material (e.g. cast iron). First and second lapping discs 16, 18 have precisely flat working surfaces 17, 19 which are loaded with an abrasive compound (e.g. diamond, silicon carbide, fused alumina). Lapping (or "cutting") of workpieces 14 is accomplished by rubbing the abrasive-loaded working surfaces 17, 19 of first and second lapping discs 16, 18 against the surfaces of workpieces 14 at an appropriate pressure. As a general rule, it is desired to provide first and second lapping discs 16, 18 with translational two-component oscillations in the plane of their working surfaces 17, 19 (i.e. they experience oscillations in the horizontal plane defined by the X-axis and the Y-axis, as shown).

One method of doing so is to simultaneously drive first and second lapping discs 16, 18 with a disc-drive motor (not shown) through eccentric crank pins 21, 22, respectively (FIG. 1) while restraining them from rotating by elastic members 20*a*, 20*b*, respectively. First and second crank pins 21 and 22 are conventional eccentric crank pins and have eccentricity $e_1$ and $e_2$, respectively. Elastic members 20*a* and 20*b* are coupled to first and second lapping discs 16, 18, respectively, as well as to body 15 of lapping machine (FIG. 1) to prevent first and second lapping discs 16, 18 from rotating. It should by understood that other conventionally known restraining members could be used in place of elastic members 20*a* and 20*b*. Accordingly, first lapping disc 16 is provided with translational movement in the $X_1$ and $Y_1$ directions and second lapping disc 18 is provided with translational movement in the $X_2$ and $Y_2$ directions, as shown.

It should be understood that many other mechanical driving mechanisms could be used to provide first and second lapping discs 16, 18 with the desired two-component translational movement. Also, while first and second lapping discs 16, 18 are shown in a horizontal orientation in FIGS. 1 and 2, it should be understood that first and second lapping discs 16, 18 could be orientated in any other plane.

Preferably, first lapping disc 16 is provided with antiphase harmonic oscillation such that the $X_1$ and $Y_1$ components are equal in frequency (but 90 degrees out of phase) and have an amplitude of $e_1$ and second lapping disc 18 is provided with antiphase harmonic oscillation such that the $X_2$ and $Y_2$ components are equal in frequency (but 90 degrees out of phase) and have an amplitude of $e_2$. Further, it is preferred to provide harmonic oscillation to first and second lapping discs 16, 18 such that the $X_1$, $Y_1$ and $X_2$, $Y_2$ components are antiphase (i.e. the oscillations of first lapping disc 16 are 180 degrees out of phase with those of second lapping disc 18).

Accordingly, particles on the working surfaces 17, 19 of first and second lapping discs 16, 18 will have circle trajectories of radius corresponding to $e_1$ and $e_2$, respectively. It should be understood that first and second lapping discs 16, 18 may be provided with different amounts of translational movement (e.g. arbitrary frequencies and amplitudes of oscillation). However, in any case, in order for first and second lapping discs 16, 18 to provide effective treatment of workpieces 14, first and second lapping discs 16, 18 must be oscillating at an appropriate cutting speed for treating the group of workpieces 14.

When first and second lapping discs 16, 18 are provided with an oscillation of equal frequency and amplitude in antiphase, the forces of friction which act on the surfaces of workpieces 14 will cancel each other out and workpieces 14 will essentially remain motionless between first and second lapping discs 16, 18. Even where there is some small difference in the force of friction being applied to the surfaces of an individual workpiece 14 which results in it being "captured" (i.e. caught and moved) by the lapping disc which exerts the stronger force, collisions with other workpieces, collision with the walls of the socket, and general forces of inertia will quickly bring workpiece 14 to a stop and prevent it from oscillating within opening 24. It is noted that the stabilizing effect of the general inertia will increase as acceleration of oscillations of first and second lapping discs 16, 18 increases.

Cassette 12 must be rotated at a high enough speed such that individual workpieces 14 are circulated within opening 24. If a workpiece 14 remains within a particular area, the sludge which is produced during abrasive treatment, will quickly slow down treatment, almost to a stop. However, cassette 12 must also be rotated at a low enough speed so that the speed of movement of workpieces 14 within opening 24 is slow enough so as not to affect the effectiveness of cutting. Specifically, it has been determined that cassette 12 must be rotated such that points on the outside edge of cassette 12 have a linear speed which is less than the cutting speed appropriate for a particular group of workpieces 14.

When cassette 12 rotates with angular velocity Ω (FIG. 2) and first and second lapping discs 16, 18 provide oscillating force as previously described, freely placed workpieces 14 will circulate in a pseudo-random manner within opening 24. Specifically, workpieces 14 are involved in two main movements as shown by arrow A (indicating relative motion of workpiece 14 to cassette 12) and arrow B (indicating the translational speed of workpiece 14 carried by cassette 12) on FIG. 2.

Specifically, as cassette 12 rotates, wall 25 of opening 24 generally urges workpieces 14 to move in the same general direction as cassette 12. As is conventionally understood, workpieces 14 positioned at a farther distance R from the center of opening 24 will have a greater linear speed than workpieces 14 positioned at a closer distance R' from the center of opening 24. Accordingly, working surfaces 17, 19 of first and second lapping discs 16, 18 will exert greater forces of friction on those workpieces 14 positioned further away from the center of opening 24 than on those workpieces 14 positioned closer to the center of opening 24. Thus, workpieces 14 positioned further from the center of opening 24 will experience more of a retarding force against forward motion than workpieces 14 positioned closer to the center of opening 24.

Further, the presence of protrusions 26 as well as the oscillating forces provided by first and second lapping discs 16, 18 assist in urging workpieces 14 to circulate within opening 24. If first and second lapping discs 16, 18 were motionless (i.e. not undergoing oscillation), workpieces 14 would move within cassette 12 around the axis of cassette 12. Due to the combination of oscillations of the first and second lapping discs 16, 18 and the rotation of cassette 12, it has been observed that workpieces 14 move within opening 24 as if workpieces 14 were being pushed by cassette 12 under conditions of pseudo-viscous friction. This "force of friction" has been observed to increase as the speed of workpieces 14 increases.

The combination of all of these forces will result in workpieces 14 having relative motion in a direction along curved wall 25 that is opposite to the rotational motion of cassette 12 (arrow A in FIG. 2). Simultaneously, workpieces 14 will have translational motion together with cassette 12 (arrow B in FIG. 2). The overall movement of workpieces 14 will then be the combination of motion represented by arrow A and arrow B. The result is that workpieces 14 will circulate in a pseudo-random fashion within opening 24 of cassette 12.

Correspondingly, working surfaces 17, 19 of first and second lapping discs 16, 18, will be more evenly worn than is possibly using conventional lapping machines and lapping assembly 10 will provide even treatment to workpieces 14 on both sides. Since opening 24 is large enough to hold large quantities of workpieces 14 and cassette 12 does not require every workpiece 14 to be put in a separate socket, a higher number of workpieces 14 may be processed than is possible using conventional lapping machines and loading and unloading of workpieces 14 can be accomplished at a much faster rate. Also, when loading workpieces 14 into opening 24, it is not necessary to position each workpiece 14 flat on second lapping disc 16. Workpieces 14 are arranged on top of each other will quickly array themselves into one layer on the surface of second disc 16 once circular oscillation is provided to cassette 12. Finally, when cassette 12 is filled with workpieces 14, it is possible to "correct" (i.e. re-establish a flat profile of) working surface 17, 19 of first and second lapping discs 16, 18, preferably using cylinders.

It should be understood that opening 24 of cassette 12 can be of any general shape, as long as at least two points on wall 25 of opening 24 are spaced apart from the center of rotation of either cassette 12 and/or first and second lapping discs 16, 18 at varying distances. That is, opening 24 can be of any general shape which allows workpieces 14 positioned against wall 25 to be able to easily move to another position along wall 25 which is at a different distance away from the center of rotation discussed above. As discussed above, since the linear speed of workpiece 14 varies with the distance it is from the center of rotation, workpieces 14 will circulate within opening 24 as long as it is possible for workpieces 14 to experience different degrees of linear speed (and thus different degrees of friction from first and second lapping discs 16 and 18) as workpieces 14 traverse within opening 24. It should be understood however, that when shapes which contain corners (e.g. square or triangle shapes), workpieces 14 tend to get caught within the corners and movement of workpieces 14 within opening 24 is appreciably limited.

Figure 3:
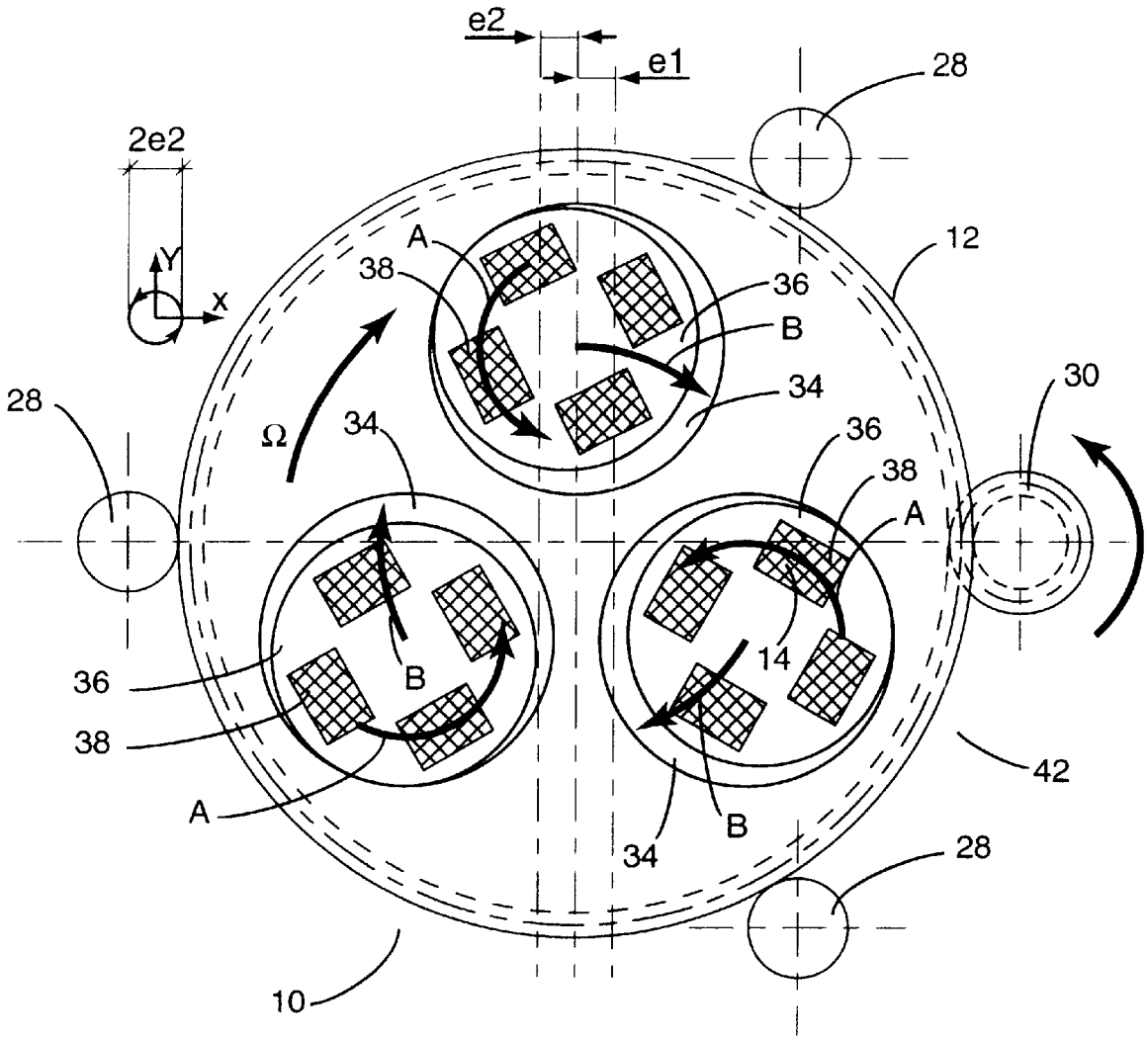
FIG. 3 is top plan view of an alternative embodiment of the cassette of FIG. 1.

FIG. 3 shows an alternative embodiment of lapping assembly 10 wherein a socket-type cassette 42 is utilized. Cassette 42 contains a number of apertures 34, each of which are sized to receive a satellite disc 36. Each satellite disc 36 has a diameter which is slightly smaller than that of the corresponding aperture 34 and contains individual sockets 38 adapted to receive individual workpieces 14. Where there is are insufficient number of workpieces 14 to fill the space of opening 24, a smaller number of workpieces 14 can still be treated by inserting individual workpieces 14 into cassette 42.

Workpieces 14 located within sockets 38 of satellite discs 36 move in relation to first and second lapping discs 16, 18 along epicycloid trajectories, similar to those in prior art planetary lapping machines. However, working surfaces 17, 19 of first and second lapping discs 16, 18 are worn more evenly than would be so in the case of prior art planetary lapping machines, due to translational motion of cutting first and second lapping discs 16, 18. The oscillatory motion of first and second lapping discs 16, 18 assists satellite discs 36 in circulating freely within apertures 34. Although cassette 12 of FIG. 2 achieves more even wear of first and second lapping discs 16, 18 than cassette 42 of FIG. 3, cassette 42 is still beneficial where a small quantity of workpieces 14 are to be treated.

Figure 4:
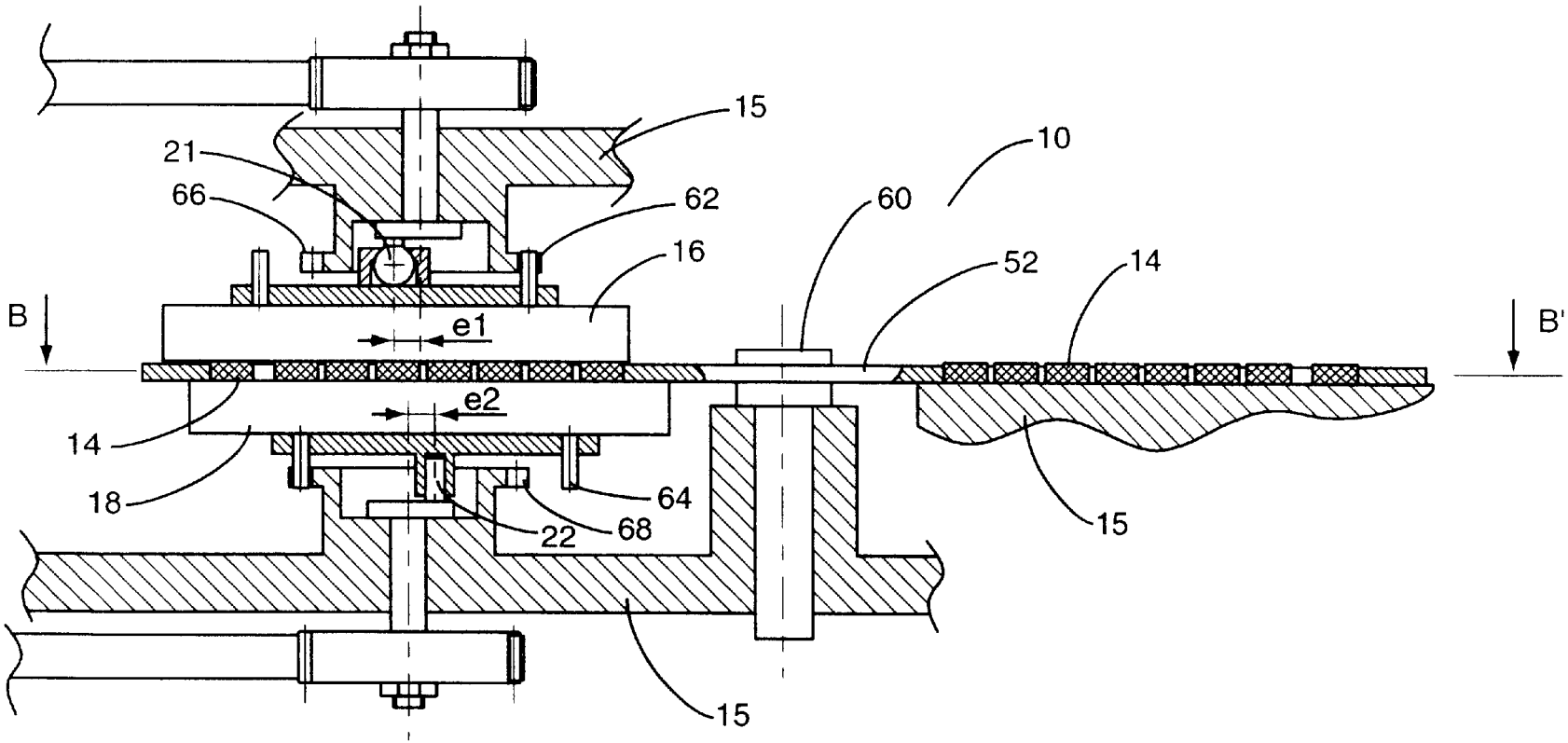
FIG. 4 is side cross-sectional view of the lapping assembly containing an alternative embodiment of the cassette of FIG. 1.
Figure 5:
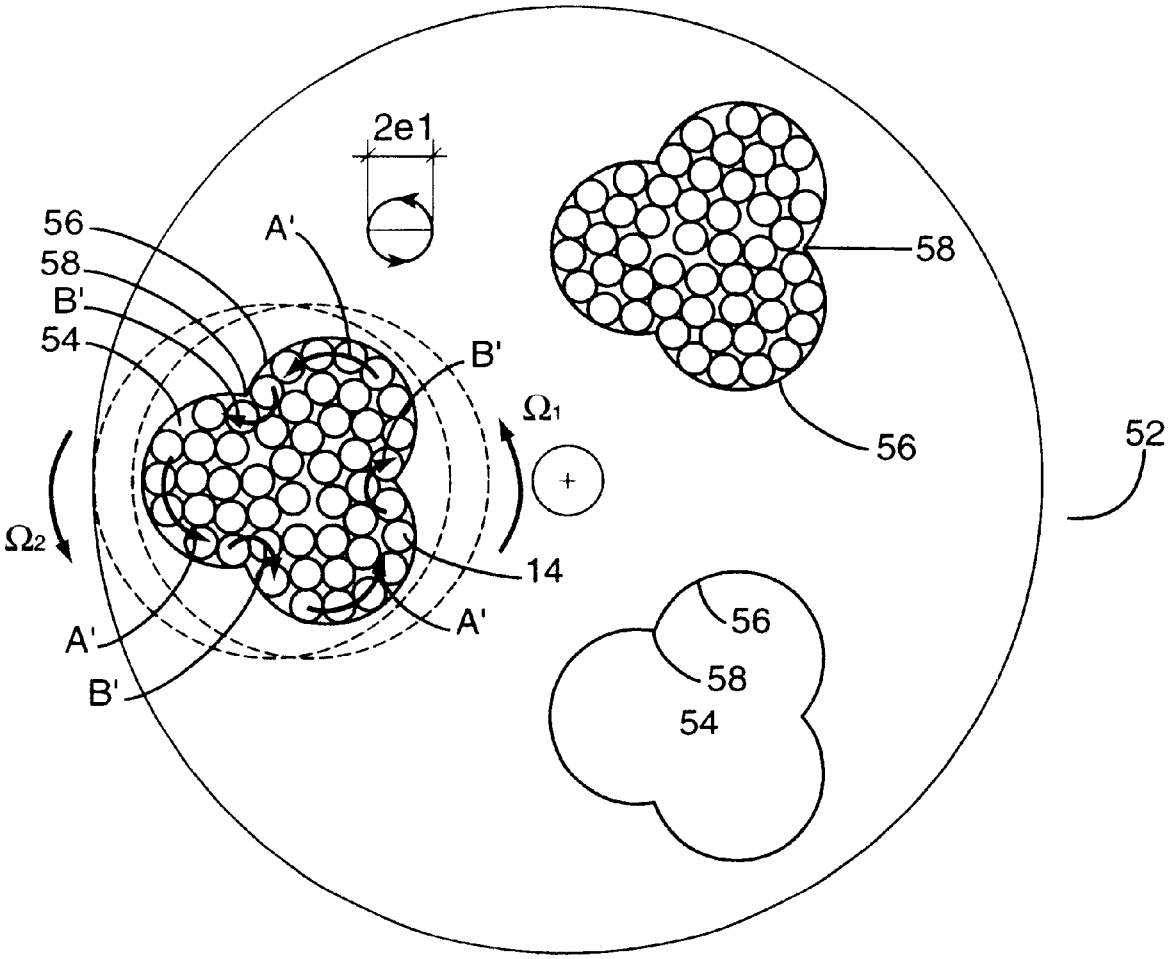
FIG. 5 is a sectional view of the lapping assembly taken along the line B—B' of FIG. 4.

FIGS. 4 and 5 show an alternative embodiment of lapping assembly 10 wherein an extended cassette 52 is used to further facilitate automatic loading and unloading of workpieces 14. Cassette 52 includes a plurality of identical openings 54, each opening 54 having an outside edge 56 with a curvilinear shape (similar to opening 24 of FIGS. 1 and 2). As a result, protrusions 58 are present along each outside edge 56 and extend into each opening 54. Cassette 52 is rotatably supported by shaft 60 so that while workpieces 14 within one opening 54 are receiving treatment, workpieces 14 from the other openings 54 can be appropriately loaded and unloaded.

In this embodiment, cassette 52 is motionless during treatment and first and second lapping discs 16, 18 are oscillated using eccentric crank pins 21 and 22 (FIG. 5), as previously described in relation to FIGS. 1 and 2. In contrast to the embodiment of lapping assembly 10 shown in FIGS. 1 and 2, elastic members are not employed to restrain the rotational movement of first and second lapping discs 16, 18. First and second lapping discs 16, 18 are preferably provided with low angular velocity $\Omega_1$, and $\Omega_2$ (e.g. and preferably so that $\Omega_1=\Omega_2$). It should be understood that it would also be possible to provide different angular velocities to first and second lapping discs 16, 18, or alternatively, to provide rotation to only one of first and second lapping discs 16, 18.

A conventional cogwheel drive mechanism having cogwheels 62 and 64 is seated on first and second lapping discs 16, 18, and used to drive eccentric crank pins 21 and 22 as shown. Gear wheels 66 and 68 are coupled to cogwheels 62 and 64, respectively as well as to body 15 of the lapping machine. It should be understood that any conventionally known drive mechanism may be used to rotate one or both of first and second lapping discs 16, 18, as appropriate.

As specifically shown in FIG. 5, when cassette 12 is fixed and first and second lapping discs 16, 18, are oscillated in the eccentric manner described, workpieces 14 generally experience a combination of oscillatory forces from first and second lapping discs 16, 18 in combination with rotational forces around the axis of first and second lapping discs 16, 18 (i.e. workpieces are "dragged" behind first and second lapping discs 16, 18). The overall trajectory of workpieces 14 is the combination of motion represented by arrow A' and arrow B'.

It should be understood that the cassette of this embodiment could equally be of the form of cassette 12, previously described in relation to FIGS. 1 and 2. In such an arrangement instead of rotating cassette 12, first and second lapping discs 16, 18 are rotated, such that the same relative speed between cassette 12 and first and second lapping discs 16, 18 is provided.

Figure 6:
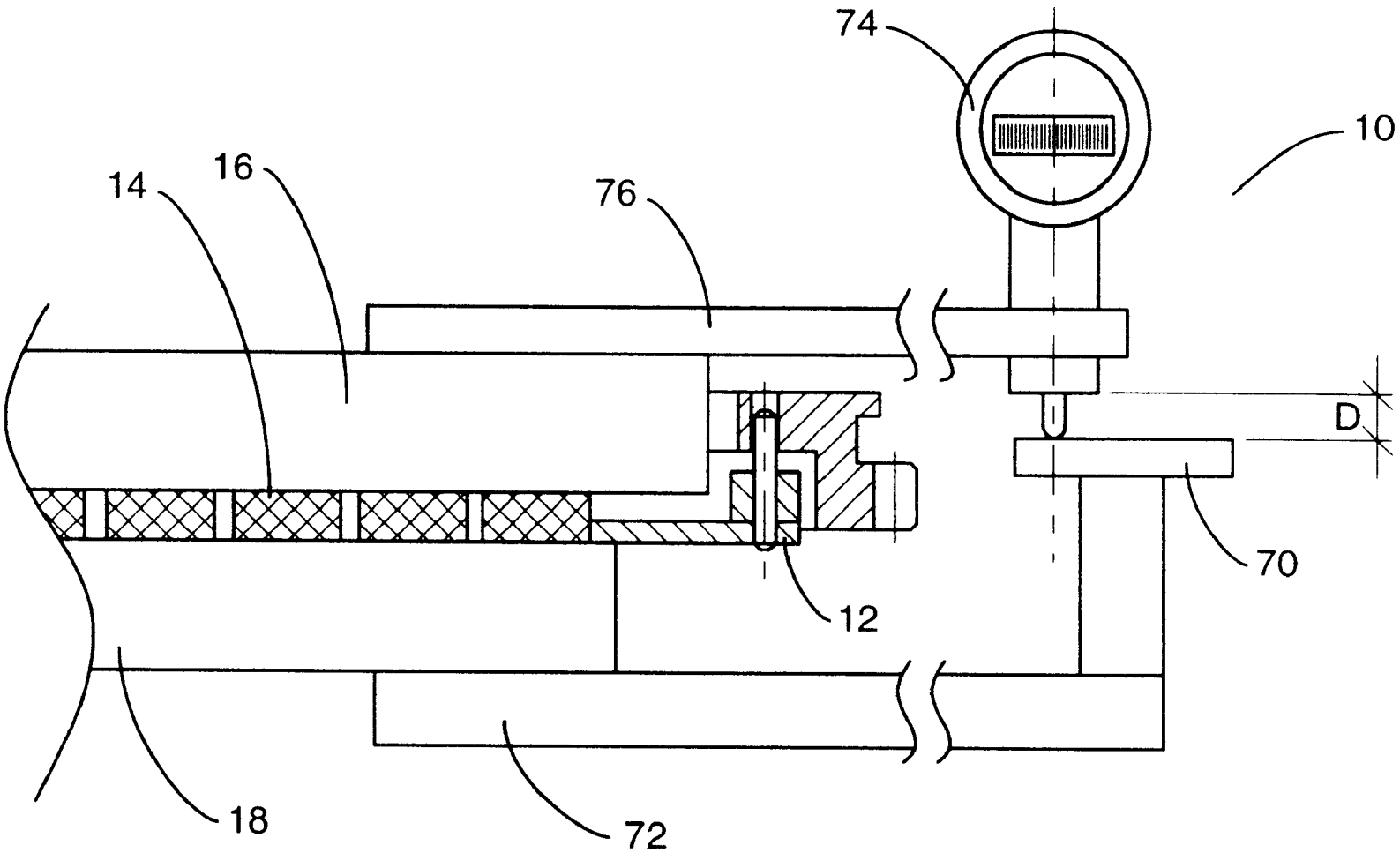
FIG. 6 is a side cross-sectional view of an alternative embodiment of the lapping assembly of FIG. 1 which includes a sensing device for controlling the thickness of the finished workpieces.

FIG. 6 shows an alternative embodiment of lapping assembly 10 wherein the height to which workpieces 14 are treated can be controlled. Specifically, second lapping disc 18 is coupled to a marking element 70 through rigid support 72. First lapping disc 16 is coupled to a sensor 74 through rigid support 76. It is possible to control the height of the finished workpiece 14 by setting the calibration instrumentation of sensor 74 to indicate when marking element 70 is a certain distance D away from sensor 74. Once sensor 74 detects and indicates (e.g. using an indicator LED) that marking element 70 is a distance D away, lapping assembly 10 could be prevented from continuing treatment of workpieces 14 either manually, or automatically using a microcontroller, as is conventionally known.

Figure 7:
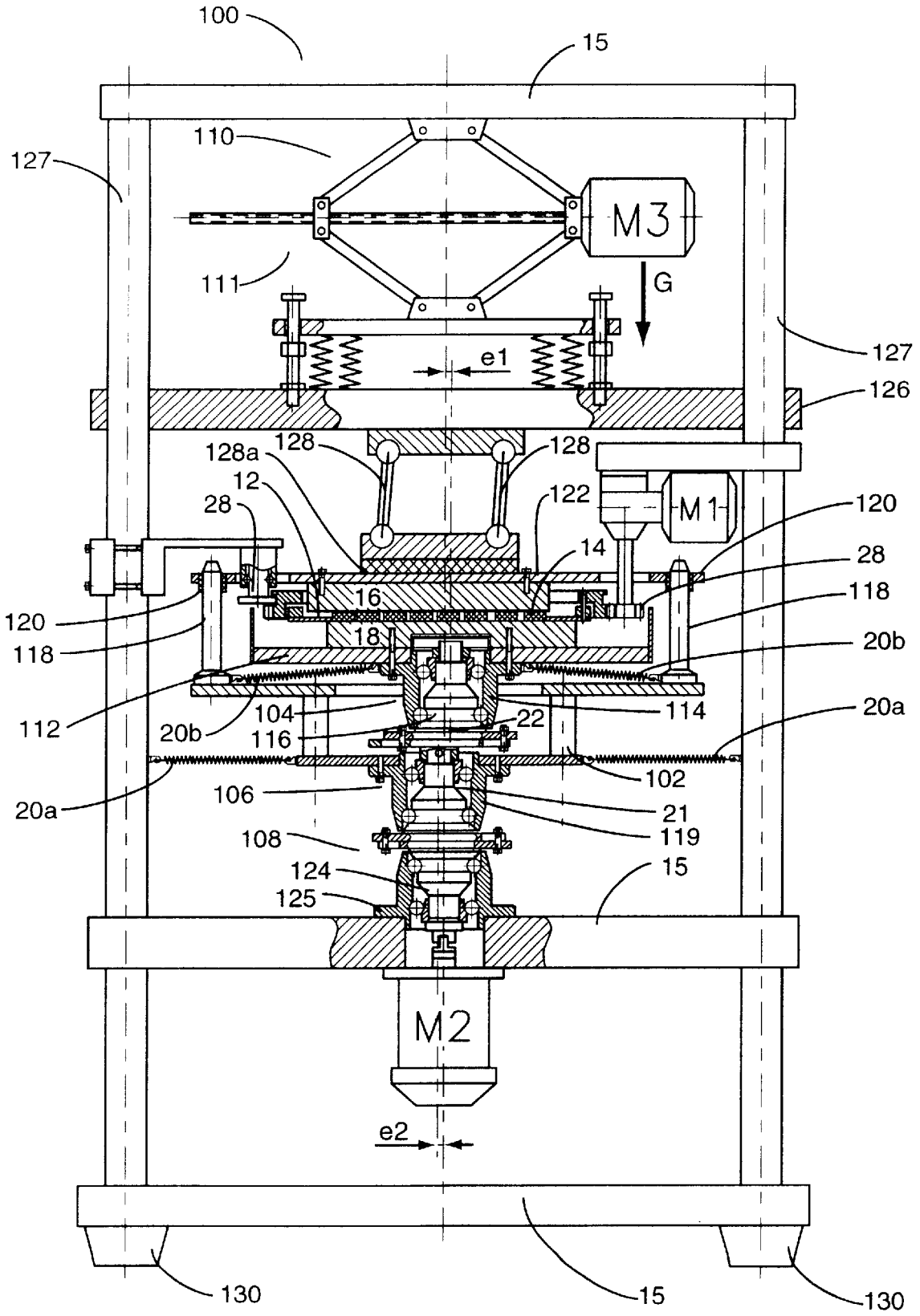
FIG. 7 is a cross-sectional view of a one-spindle lapping machine which may be used in association with the lapping assembly of FIG. 1.

FIG. 7 shows an alternative embodiment of the present invention as a one-spindle lapping machine 100 which may be used to oscillate first and second lapping discs 16, 18 and to rotate cassette 12 of lapping assembly 10, as previously discussed. Lapping machine 100 also provides a mechanism for balancing the oscillating first and second lapping discs 16, 18 so that when first and second lapping discs 16, 18 are oscillated at optimum speed, minimal oscillations are transferred to body 15 of lapping machine 100. Lapping machine 100 includes a rigid frame 102, a second disc spindle assembly 104, an first disc spindle assembly 106, a bottom spindle assembly 108, and a pressurizing assembly 110.

Second lapping disc 18 is coupled to a tank 112 and is seated on nave 114 which is equipped with a radially supporting rolling bearing, as is conventionally known. Second crank pin 22 is coupled to a driving shaft 116 which rotates inside nave 114. Elastic members 20*b* are coupled to second lapping disc 18 and to body 15 of lapping machine 100 to prevent second lapping disc 18 from rotating about its axis. The resulting motion is a two-component translational oscillation, as previously described.

First lapping disc 16 receives circular oscillations from first disc spindle assembly 106 through rigid frame 102 and two dog columns 118, which enter openings 120 of plate 122, rigidly connected to first lapping disc 16. In order to effect noiseless breaking of dog columns 118, rolling bearings could be installed in openings 120. First crank pin 21 rotates inside nave 119 and is rigidly connected to a drive shaft 124, which rotates inside bottom nave 125 of motionless spindle assembly 108 by means of disc-drive motor M2. Elastic members 20*a* are coupled to first lapping disc 16 and to body 15 of lapping machine 100 to prevent first lapping disc 16 from rotating about its axis. The resulting motion is a two-component translational oscillation, as previously described.

Balancing of lapping assembly 100 is achieved by driving first and second lapping discs 16, 18 in an antiphase manner through rigidly fixed together crank pins 21 and 22, respectively. Crank pins 21 and 22, together with drive shaft 124 form a unified spindle. Specifically, eccentricities $e_1$ and $e_2$ of crank pins 21 and 22, respectively must be chosen such that the static moment of first lapping disc 16 (i.e. $G_1$ $e_1$ where $G_1$ is the combined weight of first lapping disc 16 and associated parts rigidly connected) is equal to that of second lapping disc 18 (i.e. $G_2e_2$ where $G_2$ is the combined weight of second lapping disc 18 disc 16 and associated parts rigidly connected). In preferred operation, where first and second lapping discs 16, 18 are oscillated in antiphase, the cutting speed of lapping assembly 10 will be proportional to the sum of the eccentricities $e_1$ and $e_1$ (i.e. the sum of the eccentricity of the first crank pin 21 and that of the second crank pin 22).

Also, as is conventionally known, first and second lapping discs 16, 18 must be pressed together with an appropriate force G as is effected by pressurizing assembly 110. Traverse member 126, moveable on columns 127 and driven by motor M3 through conventionally known spring and hinge assembly 111, can be used to provide a specific amount of force G to first lapping disc 16 which is movably coupled to a set of dog columns 118, as shown. Alternatively, traverse member 126 could be lowered with the held of pneumatic or hydraulic cylinders. When first lapping disc 16 is positioned relatively high within lapping machine 100, plate 122 (rigidly coupled to first lapping disc 16) is elevated over dog columns 118 and is held by swivel-supporting bolts 128. Unavoidable unbalancing forces can be dampened by providing lapping machine 100 with a heavy body 15 and through the use of conventional shock absorbers 130. In this way, force G is provided to first lapping disc 16 through transverse member 126, swivel-supporting bolts 128, and flexibly adjusting bolts 128*a* such that first lapping disc 16 will self-set itself into a horizonal operational position. It should be understood that a spherical hinge, elastic element, etc. may be used instead of bolts 128*a*.

Figure 8:
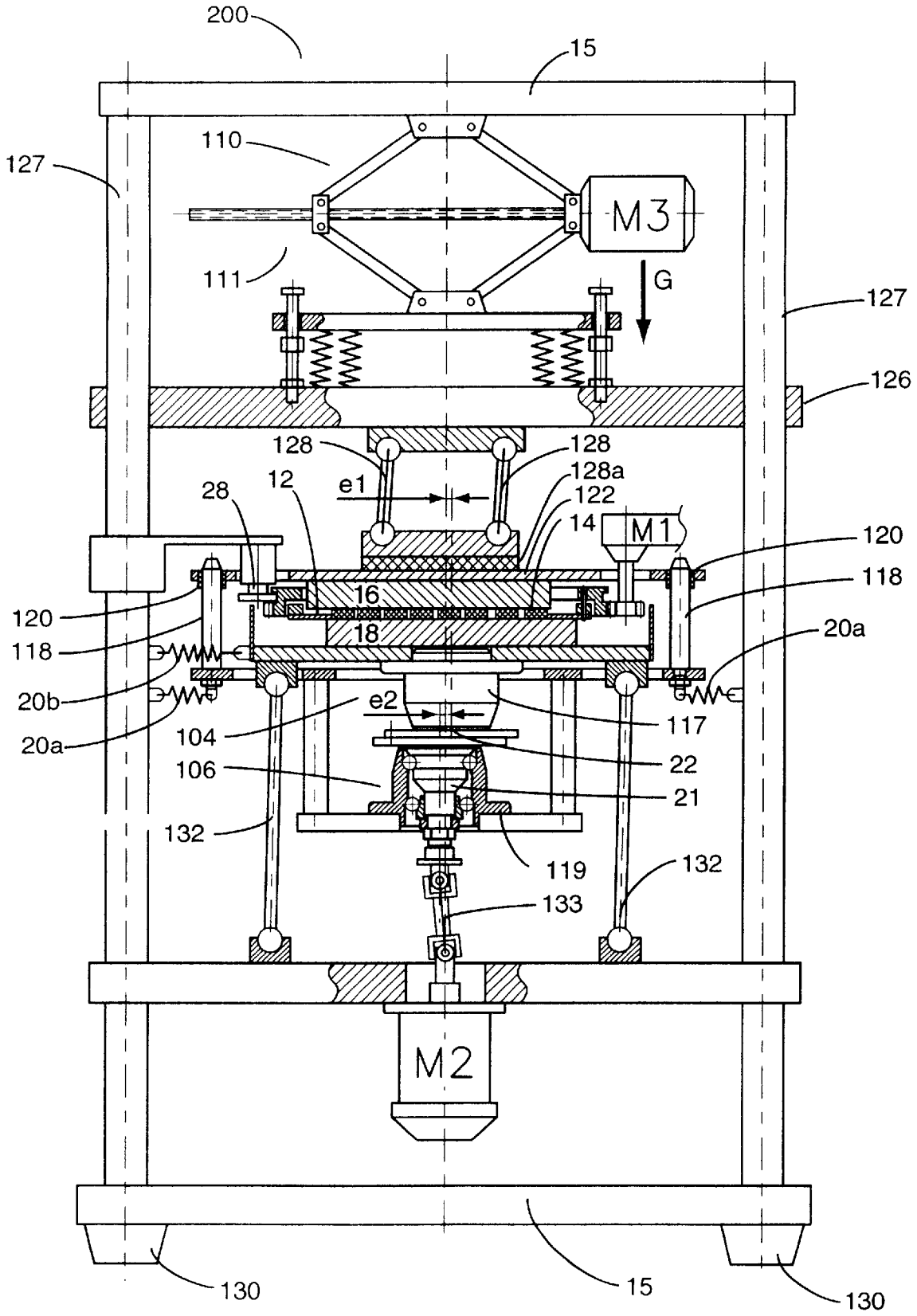
FIG. 8 is a cross-sectional view of a one-spindle lapping machine which may be used in association with the lapping assembly of FIG. 1.

FIG. 8 shows another embodiment of the present invention as a one-spindle lapping machine 200 which differs from lapping machine 100 in that it does not use driving shaft 124 and motionless spindle assembly 108 of FIG. 7. Like lapping machine 100, lapping machine 200 is used to rotate cassette 12 and to provide oscillations to first and second lapping discs 16, 18.

Second lapping disc 18 oscillates on swivel-supported bolts 132, although rubber-metallic supports, elastic bolts or planar rolling or sliding supports could be used. First lapping disc 16 is supported on swivel-supporting bolts 128 as discussed in respect of lapping machine 100. The combination of these two support structures provides lapping machine 200 with a self-balancing mechanism. That is, even if the mass of first and/or second lapping discs 16, 18 change, balancing and correlation of the real dynamic eccentricities will be adaptively achieved during the course of operation of lapping machine 200 as a result of the relative masses of weights of first and second lapping discs 16, 18 (i.e. $G_1$ and $G_2$) and the sum of eccentricities $e_1$ and $e_2$. Accordingly, there is no need to make adjustments to the individual parts of lapping machine 200.

One disadvantage of lapping machines 100 and 200 is that as the height (or diameter) of workpieces 14 receiving treatment increases, there is a commensurate rise of oscillations transferred to body 15 of the lapping machines. This is a direct result of the rigid coupling of cranks pins 21 and 22.

Figure 9:
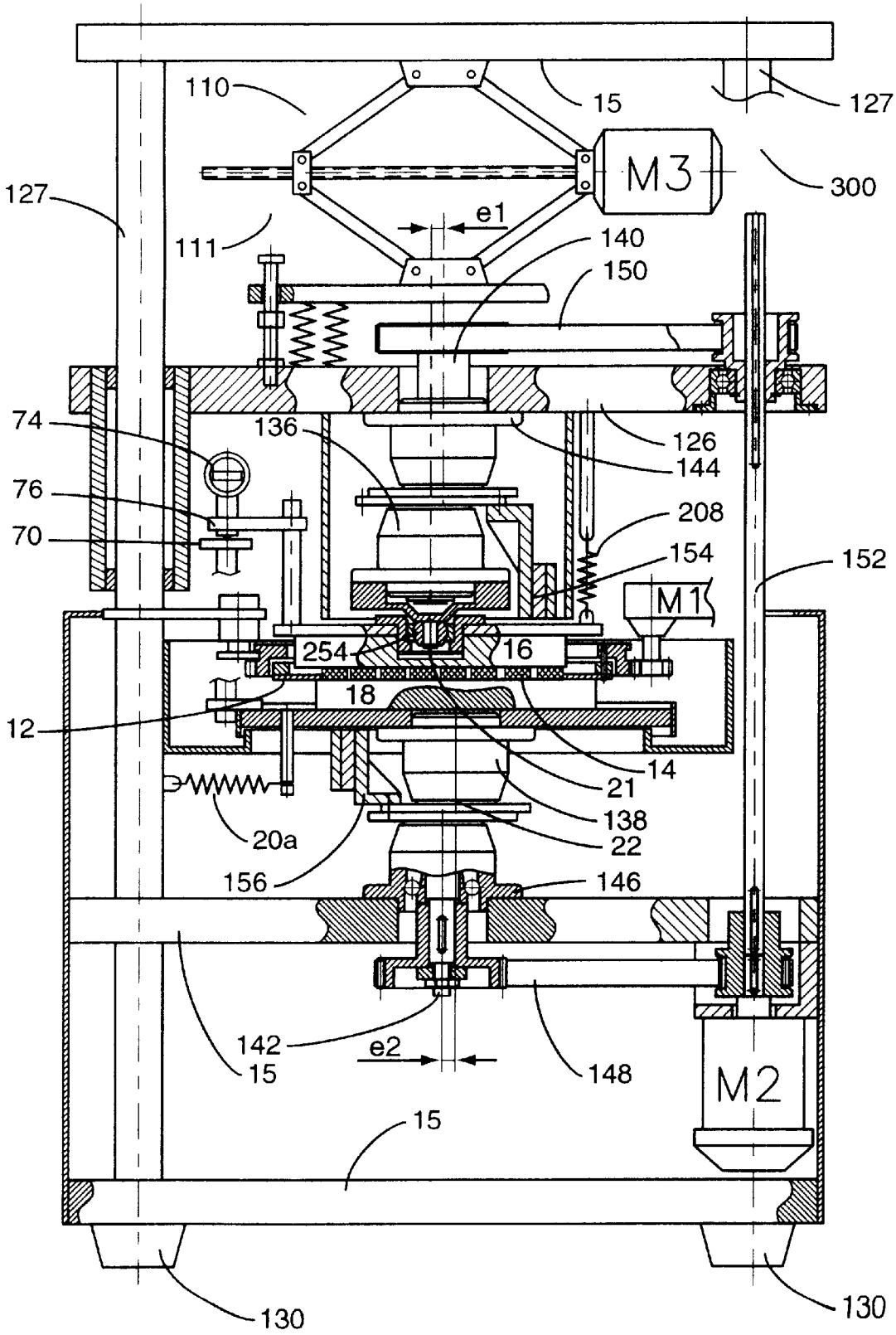
FIG. 9 is a cross-sectional view of a two-spindle machine which may be used in association with the lapping assembly of FIG. 1.

FIG. 9 shows another embodiment of the present invention as a two-spindle lapping machine 300. Lapping machine 300 is used to rotate cassette 12 and to provide oscillations to first and second lapping discs 16, 18. Lapping machine 300 uses separate eccentric crank pins 21 and 22 which independently rotate in their own naves 136 and 138, respectively. Crank pins 21 and 22 are fixed on diving shafts 140, 142 held in first and second naves 144 and 146. Second nave 146 is fixed on body 15 of lapping machine 300, and first nave 144 is fixed on traverse member 126.

In this configuration, separate motors with independent angular velocity can drive shafts 140, 142 of crank pins 21, 22 of first and second lapping discs 16, 18. Unless it is desired to obtain different qualities of top and bottom planes of workpieces 14, the rotation of crank pins 21 and 22 should be synchronized. A toothed belt gear with belts 148 and 150 is utilized to provide such rotation synchronization for crank pins 21 and 22. Rotation of shafts of first disc spindle assembly 144 and second disc spindle assembly 146 with identical angular velocities is provided by motor of disc-drive motor M2 via shaft 152. Simultaneously, first and second lapping discs 16, 18 are supplied with oscillations having eccentricities $e_1$ and $e_2$, in antiphase. Further, spindle assembly 144 is coupled to first lapping disc 16 through a spherical hinge 254. The combination of these supporting structures have the effect of reducing the amount of oscillation which is transferred to body 15 of lapping machine 300, which is especially important in the case of larger workpieces 14.

In order to provide lapping machine 300 with the ability to accommodate various-sized workpieces 14 (i.e. various distances between first and second lapping discs 16 and 18) without an commensurate increase of oscillations of the body 15 of lapping machine 300, unbalanced weights 154 and 156 can be coupled to lapping machine 300, as shown. Unbalanced weights 154 and 156 are selected in such a way so as to compensate for the centrifugal moments and forces.

Finally, as shown, sensor 74 and marking element 70 are installed within lapping machine 300. Accordingly, it is possible to control the height of the finished workpiece 14 by setting the calibration instrumentation of sensor 74 to indicate when marking element 70 is a certain distance D away from sensor 74, as previously described.

Figure 10:
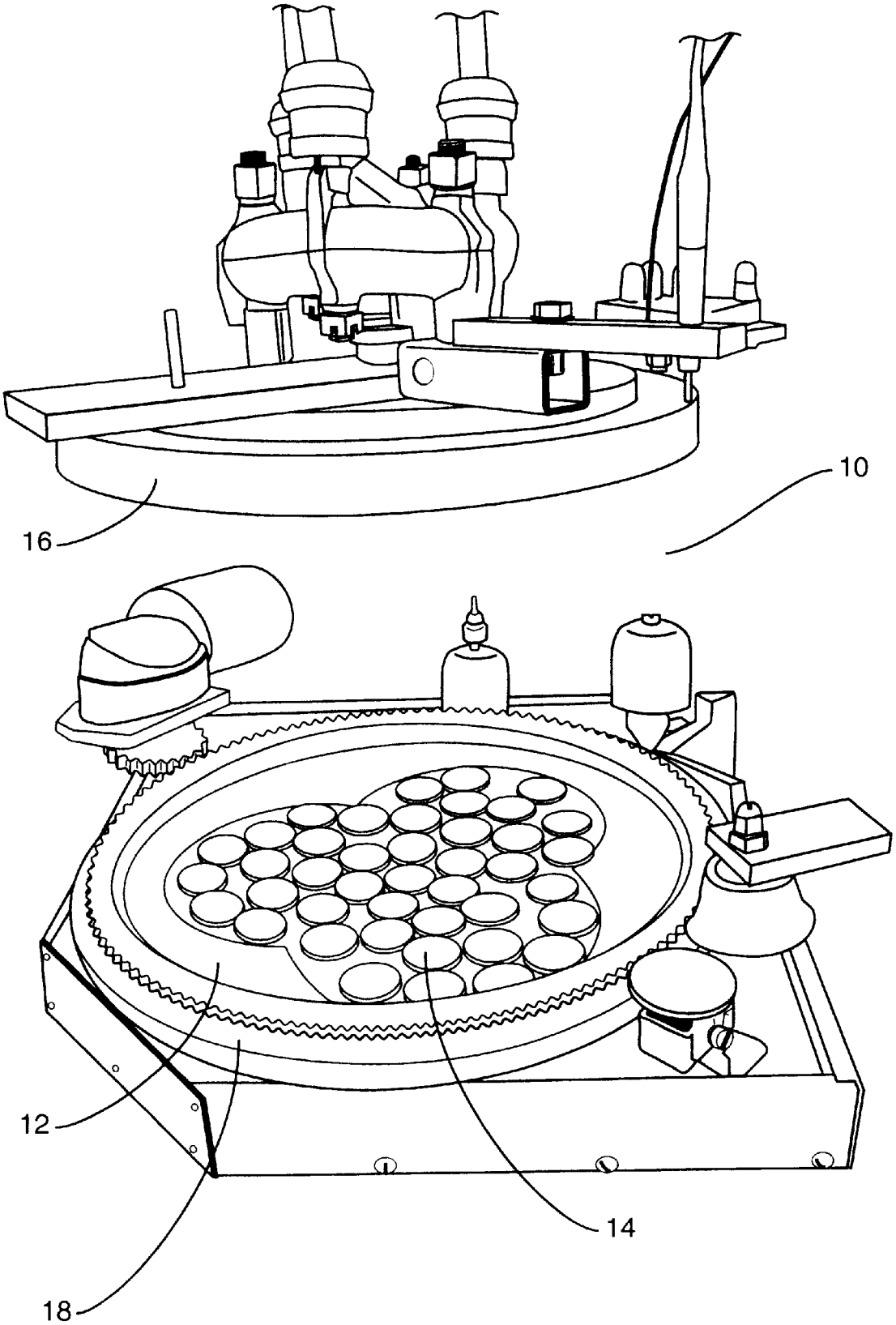
FIG. 10 is a diagrammatic view of the lapping assembly of FIG. 1.

FIG. 10 shows lapping assembly 10 in use within a typically lapping machine. Specifically, a user loads a sufficient number of workpieces 14 into opening 24 of cassette 12 to approximately fill opening 24 but leaving sufficient unoccupied space so that workpieces 14 may freely circulate within opening 24. Once workpieces 14 are positioned within opening 24, first lapping disc 16 may be lowered and locked into position with second lapping disc 18. In this position, the working surfaces 17, 19 of first and second lapping discs 16, 18 are brought into physical contact with the both surfaces of workpieces 14. Cassette 12 is then rotated in relation to first and second discs 16, 18 and first and second lapping discs 16, 18 are provided with oscillatory motion. As previously discussed, the resulting motion causes workpieces 14 to circulate within opening 24, such that working surfaces 17, 19 of first and second lapping discs 16, 18, will be more evenly worn than is possibly using conventional lapping machines and lapping assembly 10 will provide even treatment to workpieces 14 on both sides. Once lapping is finished, first lapping disc 16 can be lifted and finished workpieces 14 removed from lapping assembly 10.

Accordingly, lapping assembly 10 provides even treatment to both surfaces of a group of workpieces and effects even wear to the surfaces of lapping discs, 16 and 18. Lapping assembly 10 allows a large number of workpieces 14 to be easily loaded and unloaded from opening 24 which results in a higher yield of treated workpieces 14. In fact, it has been observed that lapping assembly 10 with first and second lapping discs 16, 18 and cassette 12 of diameter of approximately 300 millimeters can provide the same yield of treated workpieces 14 as a conventional socket-type planetary lapping machine with a diameter of 1500 millimeters.

Also, while conventional lapping machines only achieve optimally flat treatment for workpieces 14 when workpieces 14 are located at the outer extremes of cassette 12, lapping assembly 10 provides even treatment of all workpieces 14 positioned within an opening 24, due to the even circulation of workpieces 14 within cassette 12. Finally, since lapping assembly 10 does not use tooth-like elements, the typical wear and tear on conventional planetary lapping machines which utilize gears having teeth does not effect the lifetime of lapping assembly 10.

As will be apparent to persons skilled in the art, various modifications and adaptations of the structure described above are possible without departure from the present invention, the scope of which is defined in the appended claims.

We claim:

1. A lapping assembly for lapping a group of workpieces at a predetermined cutting speed, said lapping assembly comprising:

(a) first and second lapping discs, said lapping discs arranged next to one another, each said lapping disc having a working surface with abrasive particles for lapping the surfaces of the workpieces;

(b) a cassette positioned between said lapping discs for holding the group of workpieces, said cassette having a curvilinear opening formed within and dimensioned to receive the group of workpieces, said opening being defined by an inner wall;

(c) an oscillating assembly coupled to said lapping discs for providing two-component translational oscillations to said lapping discs in directions which are parallel to said working surfaces of said lapping discs, said translational oscillations being provided at the cutting speed of the group of workpieces; and (d) a rotational assembly coupled to at least one of said cassette and said lapping discs, such that a point on the periphery of said cassette rotates in relation to an adjacent point on at least one of said lapping disks at a linear speed which is less than said cutting speed, such that the workpieces are caused to circulate within said opening of said cassette.

2. The lapping assembly of claim 1, wherein said cassette has a plurality of protrusions formed along said inner surface for assisting with the circulation of said workpieces within said opening when said lapping assembly is in operation.

3. The lapping assembly of claim 1, wherein said cassette has a plurality of circular openings and a plurality of circular discs dimensioned to be freely received and moveable within, said circular openings, said circular discs having at least one socket dimensioned to receive an individual workpiece.

4. The lapping assembly of claim 1, wherein said cassette has a plurality of openings of curvilinear shape formed within such that each said opening has an inner surface dimensioned to receive the group of workpieces, said cassette having a plurality of protrusions formed along said inner surface of each said opening to assist with the circulation of said workpieces within at least one of said openings when said at least one of said opening is positioned between said first and second lapping discs and said lapping assembly is in operation.

5. The lapping assembly of claim 4, wherein said cassette is coupled to a support axle such that said cassette can be rotated from a first position to a second position such that at least one opening is not positioned between said lapping discs in one of said first and second position for loading and unloading of the workpieces.

6. The lapping assembly of claim 1, wherein said oscillation assembly includes first and second restraining elements and a first motor coupled to first and second eccentric crank pins, said first eccentric crank pins and said first restraining element being coupled to said first lapping disc and said second eccentric crank pin and said second restraining element being coupled to said second lapping disc, such that said first and second lapping discs are restrained from rotational movement by said first and second restraining elements.

7. The lapping assembly of claim 1, wherein said rotational assembly includes a second motor coupled to said cassette through a roller assembly such that a point on the periphery of said cassette rotates in relation to an adjacent point on at least one of said first and second lapping disks at a linear speed which is less than said cutting speed.

8. A lapping assembly for lapping a group of workpieces at a predetermined cutting speed, said lapping assembly comprising:

(a) first and second lapping discs, said lapping discs arranged next to one another, each said lapping disc having a working surface with abrasive particles for lapping the surfaces of the workpieces;

(b) a cassette positioned between said lapping discs for holding the group of workpieces, said cassette having an opening formed within and dimensioned to receive the group of workpieces, said opening being defined by an inner wall;

(c) an oscillating assembly comprising a first motor and first and second eccentric crank pins, said first eccentric crank pin being coupled to said first lapping disc and said second eccentric crank pin being coupled to said second lapping disc, said oscillating assembly providing two-component translational oscillations to said lapping discs in directions which are parallel to said working surfaces of said lapping discs, said translational oscillations being provided at the cutting speed of the group of workpieces.

9. The lapping assembly of claim 8, wherein said first and second lapping discs are prevented from rotation by restraining elements.

10. The lapping assembly of claim 9, wherein said restraining elements are fixed spring members.

11. The lapping assembly of claim 9, wherein said restraining elements are fixed swivel support members.

12. The lapping assembly of claim 8, further comprising a rotational assembly which includes a second motor coupled to said cassette such that a point on the periphery of said cassette rotates in relation to an adjacent point on at least one of said first and second lapping disks at a linear speed which is less than said cutting speed.

13. The lapping assembly of claim 8, wherein said rotational assembly includes said first motor coupled to said first and second eccentric crank pins through a gear assembly, said first eccentric crank pin being coupled to said first lapping disc and said second eccentric crank pin being coupled to said second lapping disc, such that a point on the periphery of said cassette rotates in relation to at least one of said lapping disks at a linear speed which is less than said cutting speed.

14. The lapping assembly of claim 8, further including a sensor coupled to one of said lapping discs and a measuring element coupled to the other of said lapping disc such that when said sensor is a predetermined distance from said measuring element, said sensor will indicate that lapping has been completed.

15. The cassette of claim 8, wherein said opening is a curvilinear shape and said cassette has a plurality of protrusions formed along said inner surface for assisting with the circulation of said workpieces within said opening when said cassette is rotated in relation to said lapping assembly.

16. A method of lapping a group of workpieces at a predetermined cutting speed, the workpieces being housed within a cassette having a curvilinear opening formed therein, said cassette being positioned between first and second lapping discs, said first and second discs each having a working surface having abrasive particles for lapping a surface of the workpieces, said method comprising the steps of:

(a) allowing said workpieces to move freely inside the opening of the cassette, said curvilinear shape serving to maintain the surfaces of the workpieces in contact with the working surfaces of the lapping discs;

(b) providing translational oscillations to the lapping discs in a plane parallel to the working surfaces of the lapping discs at the cutting speed; and (c) rotating said cassette in relation to at least one of the lapping discs, such that a point on the periphery of said cassette rotates in relation to an adjacent point on at least one of said lapping disks at a linear speed which is less than said cutting speed.

17. The method of claim 16, wherein the cassette is maintained in a fixed position during lapping and at least one of the first and second lapping discs is rotated about their own axis.

18. The method of claim 16, wherein the first and second lapping discs are restrained from rotational movement about their own axis.

19. The method of claim 16, wherein said lapping discs are supplied with translational oscillations such that the particles on the working surfaces of the lapping discs have circular trajectories of equal frequency and of opposite direction.

* * * * *